US006171068B1

(12) United States Patent
Greenberg

(10) Patent No.: US 6,171,068 B1
(45) Date of Patent: Jan. 9, 2001

(54) VACUUM PUMP

(76) Inventor: Dan Greenberg, 4 Haganim Street, Kiryat Bialik 27206 (IL)

( * ) Notice: Under 35 U.S.C. 154(b), the term of this patent shall be extended for 0 days.

(21) Appl. No.: 09/366,534

(22) Filed: Aug. 4, 1999

(30) Foreign Application Priority Data

Aug. 13, 1998 (IL) ..... 125791

(51) Int. Cl.[7] ..... F04F 5/00
(52) U.S. Cl. ..... 417/174; 417/176; 417/179
(58) Field of Search ..... 417/174, 190, 417/191, 170, 176, 179

(56) References Cited

U.S. PATENT DOCUMENTS

| | | | | |
|---|---|---|---|---|
| 3,959,864 | * | 6/1976 | Tell | 29/156.4 R |
| 4,395,202 | * | 7/1983 | Tell | 417/169 |
| 4,466,778 | * | 8/1984 | Volkmann | 417/174 |
| 4,554,956 | * | 11/1985 | Greenberg | 141/65 |
| 4,696,624 | | 9/1987 | Bass et al. | 417/56 |
| 4,696,625 | * | 9/1987 | Greenberg | 417/174 |
| 4,880,358 | * | 11/1989 | Lasto | 417/174 |
| 4,960,364 | * | 10/1990 | Tell | 417/174 |
| 5,205,717 | | 4/1993 | Tell | 417/189 |
| 5,228,839 | * | 7/1993 | Peterson et al. | 417/174 |

* cited by examiner

*Primary Examiner*—Timothy S. Thorpe
*Assistant Examiner*—Robert Z. Evora
(74) *Attorney, Agent, or Firm*—Evenson, McKeown, Edwards & Lenahan, P.L.L.C.

(57) ABSTRACT

A hybrid vacuum pump comprising an ejector type compressed air-operated vacuum pump. Such pump comprises a housing having an inlet for compressed air, a second inlet connectable to the enclosure to be evacuated, and a discharge outlet. The incoming compressed air being divided into at least two parallel streams by a multiple-outlet chamber, each stream of compressed air passing through at least two nozzles arranged in series, intermediate chambers between successive nozzles of each parallel stream being provided separately for each stream. Pressure-operated valves being provided to automatically prevent flow of gas being evacuated to some of said nozzles as progress is made in producing the desired vacuum, and thus to increase air flow in the remaining nozzles for the achievement of a high vacuum. The pump being characterized by the use of a single body structure being used to support multiple nozzles having different forms.

12 Claims, 4 Drawing Sheets

VACUUM PUMP

FIELD OF THE INVENTION

The present invention relates to vacuum pumps.

More particularly, the invention provides an ejector type hybrid vacuum pump containing multiple nozzles arranged for achieving high evacuation rates and for operating at high efficiency.

BACKGROUND OF THE INVENTION

Vacuum pumps are widely used in industry, materials handling and transport, research, medical and even agricultural applications. The degree of vacuum required determines which type of pump is most suitable.

Conventional vacuum pumps are typically driven by an electric motor or an internal combustion engine. The three most common types are the centrifugal blower, vane pumps and piston pumps.

Ejector type pumps are used to produce absolute air pressures of 60 mm Hg single stage and 10 mm double stage. More stages can be added, but at the very high vacuum needed for applications such as vacuum coating optical parts or for vacuum deposited thin films for microminiaturization other types of pumps, such as the rotary oil-sealed type or the diffusion pump are more suitable. A commercially-available hybrid combination, for example a steam jet/liquid ring pump may be the best choice for some applications.

Vacuum pumps are most effective when positioned as near as possible to their point of use in order to avoid long connector tubes which need to be evacuated each time vacuum is to be used. For example, where the vacuum is used by a robot for materials handling tasks, the pump is preferably positioned on the robot arm. However robot arm movements are slowed, or even prevented, if a heavy load is attached to such arm. Consequently, it is an advantage for vacuum pumps for such use to be compact and of light weight. Many conventional vacuum pumps having metal bodies and attached electric motors are quite unsuitable for such service.

Ejector pumps, formerly known as jet pumps, operate on the Bernoulli Principle by use of a nozzle discharging a high velocity gas stream across a suction chamber connected to the equipment to be evacuated. The gas to be evacuated is entrained by the high pressure gas and is carried into a venturi-shaped diffuser which converts the velocity energy of the high-pressure gas into pressure energy.

Any available pressured gas may be used as a power source, but in practice the gas used is either steam or air.

Ejector pumps have attractive advantages over other types in that they have no moving parts, and have low capital and maintenance costs. Disadvantages are that energy costs are higher; and although air is free, compressed air can be expensive relative to electricity. Noise may also be a problem, though an adequately-sized silencer fitted at the discharge port can reduce this to an acceptable level.

Vacuum pumps of any type, including the ejector type, may be connected in series for achievement of higher vacuum or in parallel for reaching the required vacuum more quickly. The two types of connection may be combined to produce a series-parallel pump array.

Multi-stage ejectors offer advantages in efficiency and in lower noise levels. Multi-stage ejectors produce more vacuum flow than compressed air consumption, as opposed to single stage pumps where more compressed air is consumed than is withdrawn in achieved vacuum evacuation.

Noise levels of multi-stage devices are in the range of 55 to 75 dBA, usually not requiring a silencer, as compared to the typical 90 dBA to be expected from single stage ejectors making installation of a silencer mandatory.

In U.S. Pat. No. 4,696,624 the present inventor disclosed a method of producing an ejector device wherein a plurality of ejector units positioned in a common housing each has a suction chamber. The device is series-parallel type, and has flap valves allowing air passage from one chamber to the next.

A similar device is described and claimed by Lasto in a later U.S. Pat. No. 4,880,358.

The geometry of the optimum nozzle is mainly a function of the area of the motive gas nozzle and venturi throat, pressure of the motive gas, and suction and discharge pressures; further factors of secondary importance also have a bearing on the result. What is clear is that optimum desired geometry for a nozzle will change as the pump makes progress in evacuating a chamber. At start-up the ejector pump is expected to quickly remove large quantities of gas against little resistance, while towards the end of its activity the pump has to remove small quantities of gas against much higher resistance. For whichever situation the ejector nozzle is optimized, energy in the form of compressed motive gas is wasted at either the beginning of pumping or towards the end, because the nozzle form and dimensions cannot suit the changing conditions of operation.

This problem is recognized by Tell, who proposes in U.S. Pat. No. 5,205,717 a method of achieving, with at least two compressed air operated ejectors, a desired sub-pressure in the shortest possible time and with the least use of energy. The ejectors are connected to work one at a time in response to whichever of them is supplied with compressed air. Compressed air supply is controlled in response to the sub-pressure in a collection chamber common to all ejectors.

An ejector array for the method includes at least two nozzles each having an optimum efficiency at a different value of supplied compressed air. A sensor measures sub-pressure in the common chamber and directs compressed air to one ejector at a time in response to measured sub-pressure. In operation the ejector operating best for evacuating large volumes first receives compressed air, and the nozzle operating best when evacuation pressure is low receives compressed air last.

A commercially available range of ejector-type vacuum pumps is marketed by PIAB. Lowest vacuum claimed to be achievable is between 5 and 100 millibar, depending on the model chosen.

A disadvantage of prior art ejector pumps is that efficiency is impaired by the transfer of air in intermediate chambers, that is between stages, between two parallel air streams, one of which is optimized for large volume low resistance pumping while the second stream is intended for low volume high resistance pumping. Such undesirable air transfer is made possible by the use of a common intermediate chamber for the two air streams.

It is therefore one of the objects of the present invention to obviate the disadvantages of prior art ejector pumps and to provide a pump which operates more efficiently both at the start and towards the end of vacuum draw-down.

SUMMARY OF THE INVENTION

The present invention achieves the above objects by providing in an ejector type compressed air-operated vacuum pump, comprising a housing having an inlet for compressed air, a second inlet connectable to the enclosure to be evacuated, and a discharge outlet, said incoming compressed air being divided into at least two parallel streams by a multiple-outlet chamber, each stream of compressed air passing through at least two nozzles arranged in series, intermediate chambers between successive nozzles of each parallel stream being provided separately for each stream, pressure-operated valves being provided to automatically prevent flow of gas being evacuated to some of said nozzles as progress is made in producing the desired vacuum, and thus to increase air flow in the remaining nozzles for the achievement of a high vacuum, the pump being characterized by the use of a single body structure being used to support multiple nozzles having different forms.

In a preferred embodiment of the present invention there is provided a vacuum pump of sandwich construction including at least one rigid body supporting the nozzles, a flexible gasket, and a rigid body containing a gas port, said gasket being compressed between the two rigid bodies.

In a most preferred embodiment of the present invention there is provided a vacuum pump wherein said pressure-operated valves are integral to the flexible gasket.

It will be realized that due to its modular nature the device of the present invention can serve to provide many different combinations. Each stream can be directed through multiple parallel nozzles to increase draw-down speed. Several parallel streams can be provided, each optimized to a different stage of the vacuum draw-down process. Only a few examples of the many possible combinations will be described hereinafter. Pressure sensors, such as those described by Tell are not required, as the flexible flap valves automatically direct the incoming air from the area being evacuated to the intermediate chamber operating at the sub-pressure appropriate to the present stage of draw-down.

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

SHORT DESCRIPTION OF DRAWINGS

DESCRIPTION OF PREFERRED EMBODIMENTS

Figure 1:
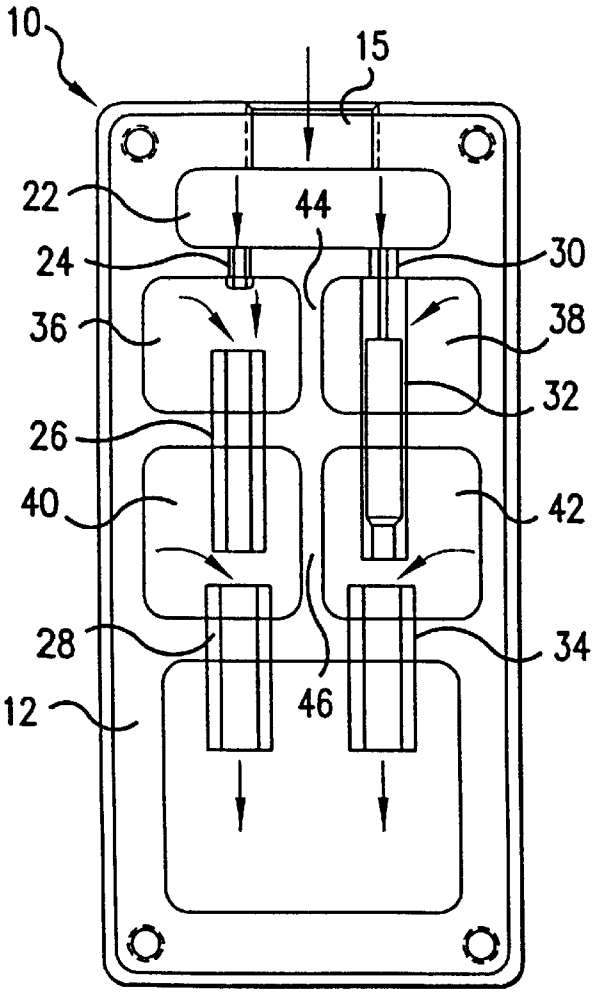
FIG. 1 is an elevational view of a preferred embodiment of the pump according to the invention.

There is seen in FIG. 1 an ejector type compressed air-operated vacuum pump 10.

Figure 2:
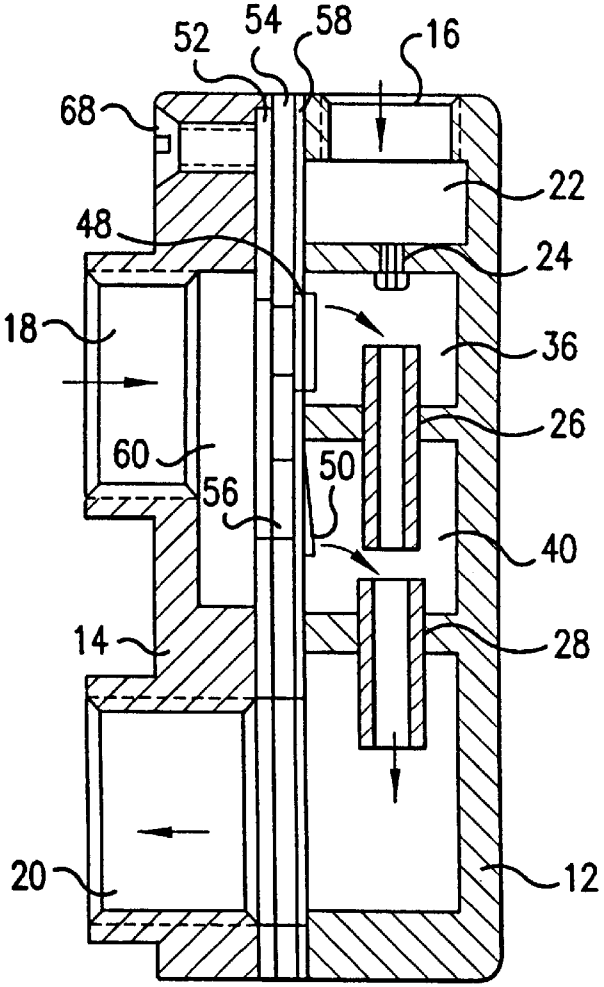
FIG. 2 is a side sectional view showing the sandwich construction of the pump.

The pump housing has two major components 12, and 14 seen in FIG. 2. Both are advantageously made of a plastic to produce a low-weight pump.

The pump has two inlets, a first inlet 16 for compressed air seen at the top of the figure, and a second inlet 18 connectable to the enclosure to be evacuated, seen in FIG. 2. A single screw-threaded discharge outlet 20, also seen in FIG. 2, serves to discharge all incoming gases; a silencer can be fitted if required.

Incoming compressed air is divided into two parallel streams by a multiple-outlet chamber 22. Each stream of compressed air then passes through three nozzles 24–34 arranged in series, each air jet passing through successively larger nozzles. Intermediate chambers 36, 38, 40, 42 between successive nozzles of each parallel stream are provided separately for each stream, each chamber drawing in gas to be evacuated. The separation walls 44, 46 between adjacent sub-pressure chambers prevent gas flow between intermediate chambers.

Pressure-operated flap valves 48, 50 seen in FIG. 2 are provided to automatically prevent flow of gas being evacuated to some nozzles as progress is made in producing the desired vacuum. Thus stronger air flow results in the remaining nozzles for the achievement of a high vacuum.

The pump is characterized by the use of a single body structure 12 being used to support multiple nozzles 24–34 having different forms. The same pump body can be used to hold nozzles having different geometry.

With reference to the rest of the figures, similar reference numerals have been used to identify similar parts.

Referring now to FIG. 2, there is seen a vacuum pump of sandwich construction. A rigid body 12 supports all the nozzles 24–34, as well as the inlet 16 for compressed air. A first flexible gasket 52, a rigid body 54 containing gas ports 56, and a second flexible gasket 58 are compressed between the two rigid bodies 12, 14 comprising the bulk of the pump.

It is seen in the figure that the nozzles 24, 26, 28, 30, 32, 34 are supported in rigid body 12, while the manifold hollow 60 appears in the second rigid body 14. This separation of functions contributes to the flexibility of the design configuration, such that different nozzle arrangements can be used without any need to change the manifold.

The second rigid body 14 includes the inlet 18 from the chamber to be evacuated, and in this embodiment also the air outlet 20.

Figure 3:
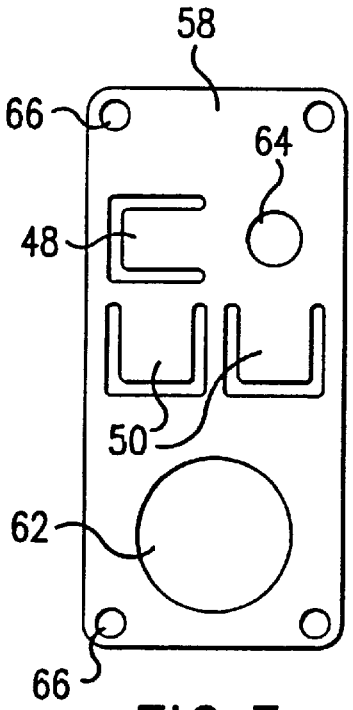
FIG. 3 is an elevational view of a gasket with integral valves.

FIG. 3 illustrates a flexible gasket of the vacuum pump described with reference to FIG. 2. Three pressure-operated valves 48, 50 are shown integral to the flexible gasket. The aperture 62 allows gas discharge. Aperture 64 allows free gas entry from the chamber being evacuated. The four corner holes 66 allow passage for fasteners 68 seen in FIG. 2 going through the whole pump.

Figure 4:
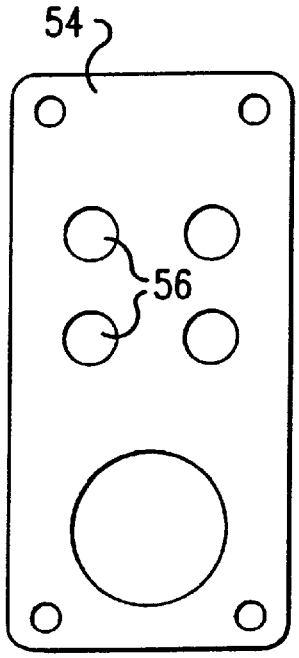
FIG. 4 is an elevational view of an intermediate plate with four gas ports.

Seen in FIG. 4 is an intermediate plate 54 which when assembled is adjacent to the gasket shown in FIG. 3. The plate carries four gas ports 56, some of which are sealed by the valves 48, 50 until pressure in the intermediate chambers 36–42 seen in FIG. 1 drops below predetermined levels towards the end of the evacuation process.

Figure 5:
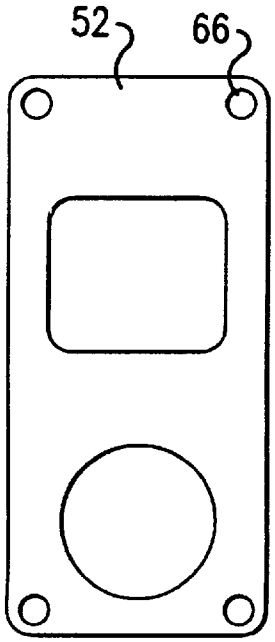
FIG. 5 is an elevational view of a seal gasket of the pump.

Referring now to FIG. 5, there is depicted a seal gasket 52 which when assembled as in FIG. 2, is disposed between the housing 14 containing the inlet 18 from the chamber to be evacuated and the plate 54 shown in FIG. 4. Where large quantities of pumps with a single configuration are to be manufactured, the intermediate plate shown in FIG. 4 is combined with the vacuum inlet rigid body and the seal gasket 52 of the present figure is then eliminated.

Figure 6:
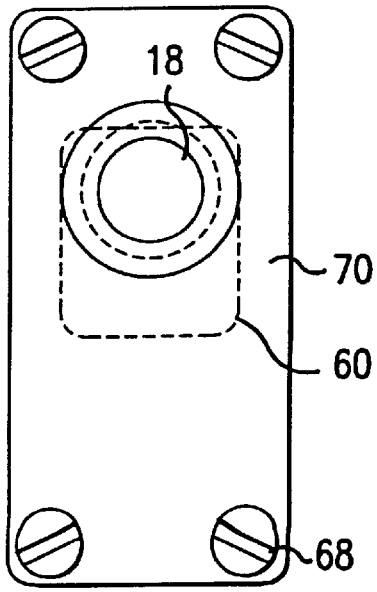
FIG. 6 is an elevational view of a pump housing body.

FIG. 6 shows an alternative a second rigid housing body 70 including the inlet 18 from the chamber to be evacuated. The body 70 does not however have an air outlet 20 as in contradistinction to the embodiment of FIG. 2, the embodiment of FIG. 6 is used in conjunction with a first rigid housing body supporting the nozzles and an having air discharge port.

Figure 7:
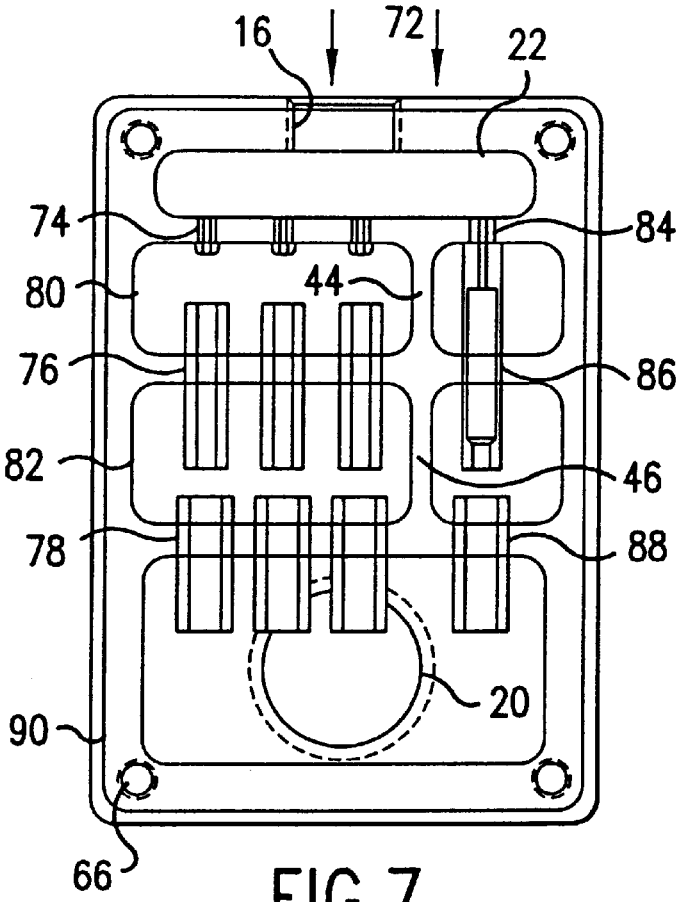
FIG. 7 is an elevational view of a pump arrangement having multiple parallel nozzles.

FIG. 7 illustrates an example pump arrangement 72 using multiple parallel nozzles 74, 76, 78 to increase the speed of vacuum draw-down. The intermediate chambers 80, 82 serving the three nozzles are each served by a single valve 48 of the type shown in FIG. 3. An additional line of nozzles 84, 86, 88 are configured for the late stage of vacuum draw-down when small quantities of gas are drawn in against high resistance. Thus it is seen that capacity can be increased without increasing the number of valves. Should it be desired to increase the number of parallel nozzles even further, the rigid housing body 90 can either be thickened, or an additional body added, to accommodate further lines of nozzles without any increase in the number of valves.

Figure 8:
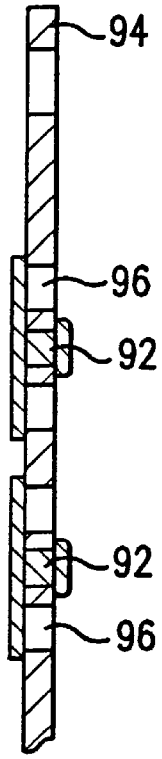
FIG. 8 is a sectional end view of a plate fitted with mushroom-type valves.
Figure 9:
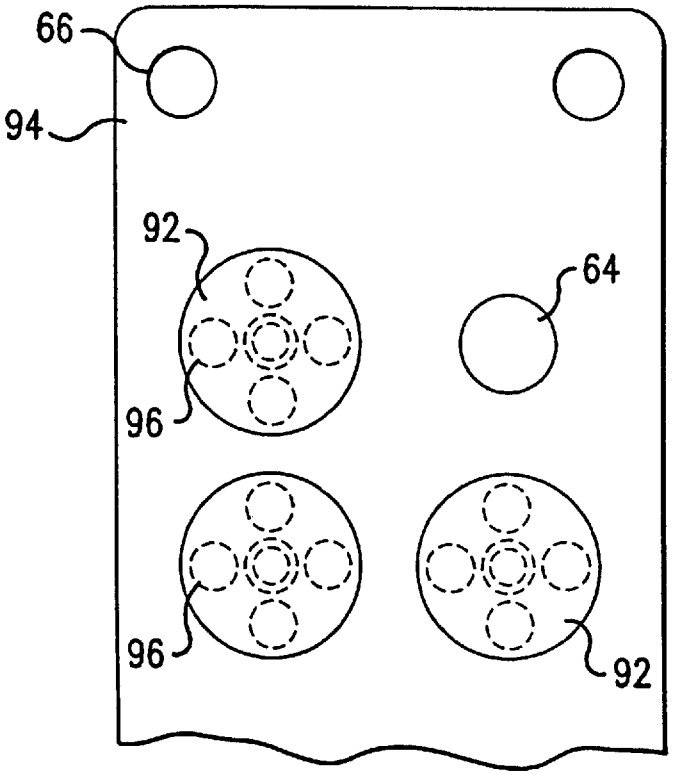
FIG. 9 is an elevational view of the same embodiment FIG. 8.

Seen in FIGS. 8 and 9 are pressure-operated flexible inlet valves 92 of a different type than that previously described, and which can be used in place of the valves 48, 50 shown in FIG. 3. The flexible inlet valves 92 are mushroom-style added-on to the rigid base plate 94. When the valve 92 opens, gas passes through the apertures 96 The valves 92 can be made of different dimensions than each other or of different materials, so that one valve will open at a higher pressure than a second valve attached to the same plate. Aperture 64 allows free gas entry from the chamber being evacuated.

Figure 10:
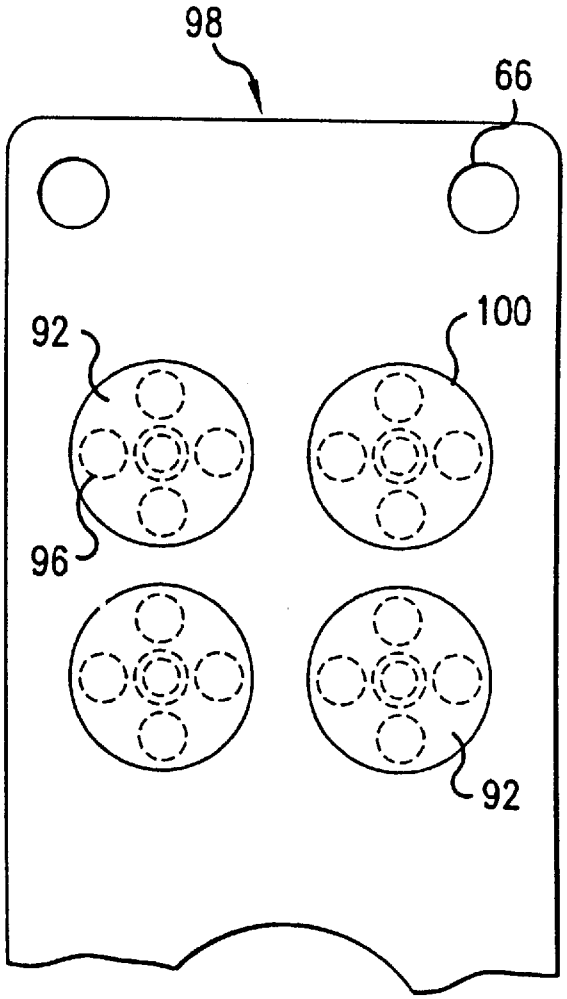
FIG. 10 is as FIG. 9 but has a one-way valve.

FIG. 10 shows a detail of a vacuum pump 98 similar to that in FIG. 9 but further comprising a one-way valve 100 in fluid communication with the second inlet 18. The one-way valve 100 prevents gas re-entering the evacuated chamber when pumping is stopped.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

What is claimed is:

1. An ejector type compressed air-operated vacuum pump, comprising, a housing structure having an inlet for compressed air, a second inlet connectable to an enclosure to be evacuated, and a discharge outlet, said incoming compressed air being divided into at least two parallel streams by a multiple-outlet chamber, each stream of compressed air passing through at least two nozzles arranged in series, intermediate chambers between successive nozzles of each parallel stream being provided separately for each stream, pressure-operated valves being provided to automatically prevent flow of gas being evacuated to some of said nozzles during production of the desired vacuum, and thus to increase air flow in the remaining nozzles for the achievement of a high vacuum, said housing structure including a first single body structure supporting a plurality of different types of said nozzles.

2. The vacuum pump as claimed in claim 1, wherein said pump is a multi ejector type.

3. The vacuum pump as claimed in claim 1, wherein said rigid bodies are made of plastic integral with one or more nozzles to produce a low weight pump.

4. The vacuum pump as claimed in claims 1 to 3, wherein said first single body structure is a rigid body and wherein said pump is of a sandwich construction including at least said first single rigid body supporting said nozzles, a flexible gasket, and a second rigid body containing a gas port, said gasket being compressed between the two said rigid bodies.

5. The vacuum pump as claimed in claims 1 to 4, wherein said pressure-operated valves are integral to said flexible gasket.

6. The vacuum pump as claimed in claims 1 to 5, wherein said rigid bodies are made of a plastic to produce a low-weight pump.

7. The vacuum pump as claims 1 to 6, wherein said pressure operated valves are separated from gasket.

8. The vacuum pump as claimed in claim 1 further comprising an inlet port and an outlet port, where the inlet port and the outlet port are on the same side.

9. The vacuum pump as claimed in claims 1 to 8 wherein the outlet port is integral with the first rigid body containing said nozzles.

10. The vacuum pump as claimed in claims 1 to 9, further comprising a one-way valve in fluid communication with said second inlet.

11. The vacuum pump as claimed in claims 1 to 11, wherein in each row of chambers can be one or more streams.

12. The vacuum pump as claimed in claims 1 to 11, further comprising a vacuum chamber, wherein said vacuum pump body and said vacuum chamber, are each a one piece structure.

* * * * *

UNITED STATES PATENT AND TRADEMARK OFFICE

CERTIFICATE OF CORRECTION

PATENT NO. : 6,171,068 B1
DATED : January 9, 2001
INVENTOR(S) : Dan Greenberg

It is certified that error appears in the above-identified patent and that said Letters Patent is hereby corrected as shown below:

This is the first correction. In the drawings, Sheet 1 of the Patent substitute with the following figure below:

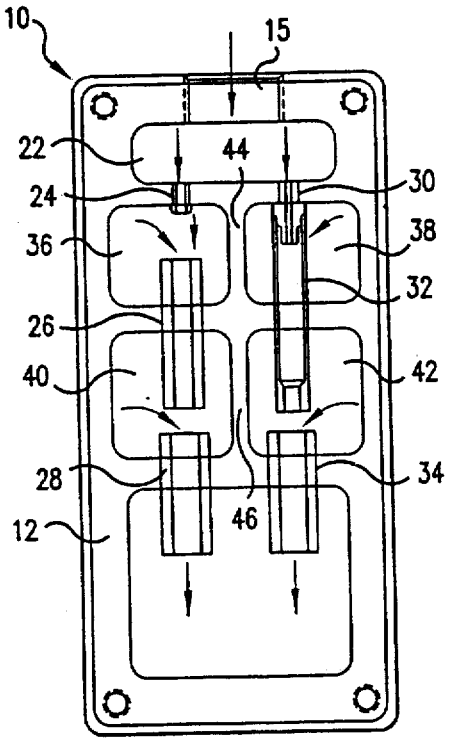

FIG. 1

UNITED STATES PATENT AND TRADEMARK OFFICE

CERTIFICATE OF CORRECTION

PATENT NO. : 6,171,068 B1
DATED : January 9, 2001
INVENTOR(S) : Dan Greenberg

It is certified that error appears in the above-identified patent and that said Letters Patent is hereby corrected as shown below:

This is the first correction. In the drawings, Sheet 3 of the Patent substitute with the following figure below:

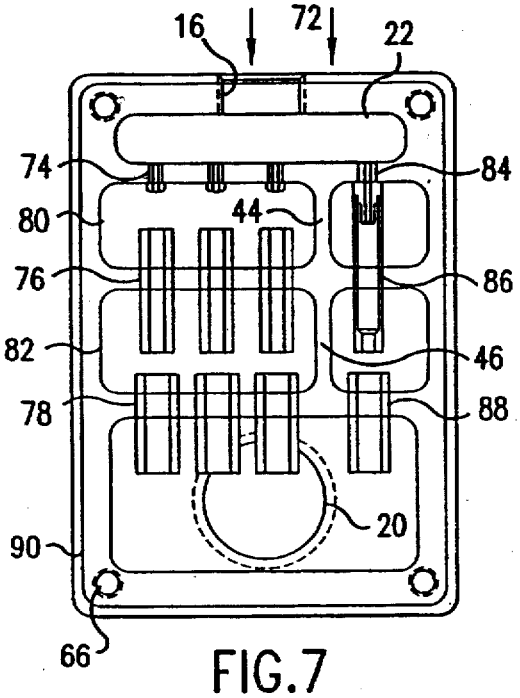

FIG.7

Signed and Sealed this

Eighteenth Day of December, 2001

*Attest:*

*Attesting Officer*

JAMES E. ROGAN
*Director of the United States Patent and Trademark Office*